US009066539B2

(12) United States Patent
Uematsu et al.

(10) Patent No.: US 9,066,539 B2
(45) Date of Patent: Jun. 30, 2015

(54) APPARATUS FOR PRODUCING A FLAVOR FOR EXPANDED TOBACCO MATERIAL

(75) Inventors: Hiromi Uematsu, Yokohama (JP); Yukio Nakanishi, Yokohama (JP)

(73) Assignee: JAPAN TOBACCO INC., Tokyo (JP)

( * ) Notice: Subject to any disclaimer, the term of this patent is extended or adjusted under 35 U.S.C. 154(b) by 1877 days.

(21) Appl. No.: 12/243,770

(22) Filed: Oct. 1, 2008

(65) Prior Publication Data

US 2009/0032036 A1 Feb. 5, 2009

Related U.S. Application Data

(63) Continuation of application No. PCT/JP2007/058087, filed on Apr. 12, 2007.

(30) Foreign Application Priority Data

Apr. 14, 2006 (JP) ..... 2006-112148

(51) Int. Cl.
*A24B 15/30* (2006.01)
*A24B 15/24* (2006.01)

(52) U.S. Cl.
CPC ..... *A24B 15/24* (2013.01)

(58) Field of Classification Search
None
See application file for complete search history.

(56) References Cited

U.S. PATENT DOCUMENTS

| | | | | |
|---|---|---|---|---|
| 3,717,155 | A * | 2/1973 | Jacin et al. | 131/352 |
| 6,637,438 | B1 * | 10/2003 | Lane | 131/290 |
| 2009/0032036 | A1 * | 2/2009 | Uematsu et al. | 131/275 |

FOREIGN PATENT DOCUMENTS

| | | | |
|---|---|---|---|
| JP | 6-98745 A | | 4/1994 |
| JP | 6-114202 A | | 4/1994 |
| JP | 06098746 A | * | 4/1994 |
| JP | 6-189732 A | | 7/1994 |
| JP | 09010502 A | * | 1/1997 |
| JP | 3014704 A | | 12/1999 |

(Continued)

OTHER PUBLICATIONS

Machine Translation of JP 06098746A to English.*

(Continued)

*Primary Examiner* — Richard Crispino
*Assistant Examiner* — Phu Nguyen
(74) *Attorney, Agent, or Firm* — Birch, Stewart, Kolasch & Birch, LLP

(57) ABSTRACT

An apparatus for producing a flavor for expanded tobacco material has an extraction vessel (2) for bringing supercritical carbon dioxide into contact with tobacco material (A) to dissolve tobacco components in the carbon dioxide; a separation vessel (14) connected to the extraction vessel (2), for separating fat-soluble ingredients of the tobacco components from the tobacco components dissolved in the carbon dioxide to retrieve the fat-soluble ingredients; and a circulation path for circulating the supercritical carbon dioxide between the extraction vessel (2) and the absorption vessel (38) storing purified water while purifying the carbon dioxide by the purification layer (4) made of activated carbon, and absorbing water-soluble ingredients of the tobacco components in purified water; and a retrieval vessel (52) for retrieving the purified water, in which the water-soluble ingredients of the tobacco components are absorbed, from the absorption vessel (38) as absorption water. The fat-soluble ingredients of the tobacco components and the absorption water are used to produce first and second flavor elements as flavor.

5 Claims, 1 Drawing Sheet

(56) References Cited

FOREIGN PATENT DOCUMENTS

| | | | |
|---|---|---|---|
| JP | 3223058 | B | 8/2001 |
| RU | 135805 | A1 | 1/1961 |
| RU | 135805 | A1 | 1/1981 |
| RU | 94001398 | A1 | 9/1995 |
| RU | 2053694 | C1 | 2/1996 |
| RU | 2238800 | C1 | 9/2004 |

OTHER PUBLICATIONS

Machine Translation of JP 09010502A to English.*

Extended European Search Report dated Jun. 13, 2012 issued in corresponding European Patent Application No. 07741523.0.

* cited by examiner

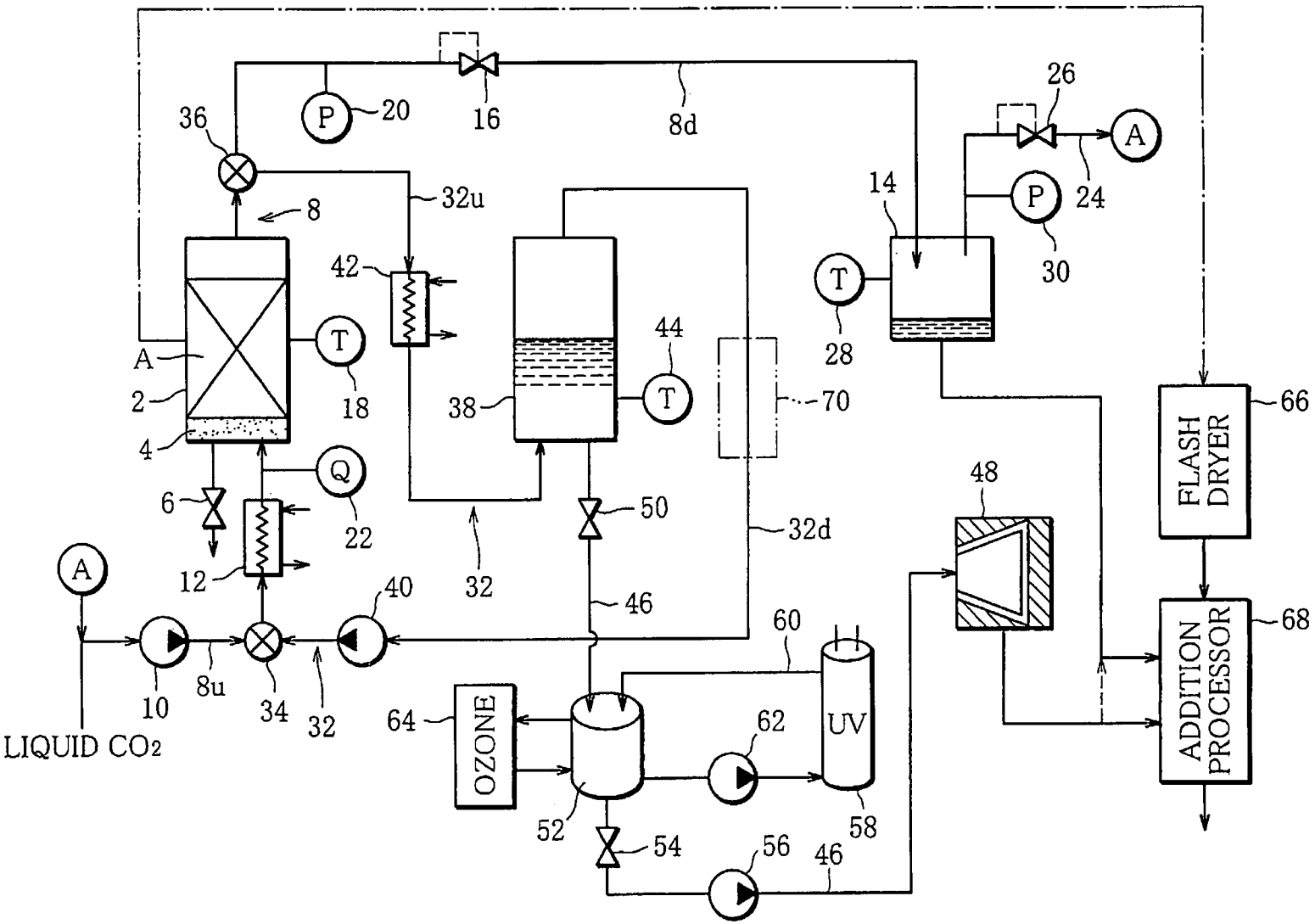
FLASH DRYER
ADDITION PROCESSOR
UV
OZONE
LIQUID CO2
A
P
T
Q

APPARATUS FOR PRODUCING A FLAVOR FOR EXPANDED TOBACCO MATERIAL

This application is a Continuation of copending PCT International Application No. PCT/JP2007/058087 filed on Apr. 12, 2007, which designated the United States, and on which priority is claimed under 35 U.S.C. §120. This application also claims priority under 35 U.S.C. §119(a) on Patent Application No(s). 2006-112148 filed in Japan on Apr. 14, 2006. The entire contents of each of the above documents is hereby incorporated by reference.

TECHNICAL FIELD

The present invention relates to an apparatus for producing a flavor for expanded tobacco material used as one of tobacco fillers of cigarettes and a method of producing the same.

BACKGROUND ART

Expanded tobacco material of this type can be obtained by impregnating a liquid expansion agent into the cellular structure of tobacco material and then rapidly heat-drying the material. In this process, the expansion agent impregnated into the tobacco material is instantly removed from the tobacco material, which expands the tobacco material.

Since this expansion process heats the tobacco material, the tobacco material is exposed to high temperature. As a result, the tobacco material is deteriorated in savor and taste. More specifically, the following fact was confirmed by an analysis of components in tobacco material, which was conducted prior to and after the expansion process. The expansion process reduces duvatrienediol (α-CBT) contained in the tobacco material up to 50 percent or more. The other tobacco components, such as nicotine and saccharide, are also reduced by the expansion process. Duvatrienediol is a kind of leaf lipid-related materials (carbon hydride in an approximate range of $C_{27}H_{56}$ to $C_{33}H_{68}$). Duvatrienediol, nicotine and saccharide are flavors inherent in tobacco material.

There has been a well-known apparatus and method for producing a flavor for expanded tobacco material, in which when an expansion agent is impregnated into tobacco material, the tobacco components dissolved in the expansion agent are retrieved from the expansion agent, and fat-soluble ingredients (wax) are removed from the extracted tobacco components in order to compensate a deterioration in savor and taste of the expanded tobacco material (Patent Document 1).

There has been another well-known method (Patent Document 2) in which water-soluble ingredients contained in tobacco components are extracted from tobacco material by causing only the water-soluble ingredients to be absorbed into water. Such water-soluble ingredients are also addible to the expanded tobacco material as flavor.

Patent Document 1: Japanese Patent No. 3014704

Patent Document 2: Japanese Patent No. 3223058

DISCLOSURE OF THE INVENTION

The fat-soluble ingredients of tobacco components are especially effective in increasing volume of the mainstream of smoke when a cigarette is smoked. However, the fat-soluble ingredients of the tobacco components are removed from the flavor disclosed in Patent Document 1, so that the flavor disclosed in Patent Document 1 cannot fully provide the savor and taste inherent in tobacco material.

The flavor disclosed in Patent Document 2 consists only of the water-soluble ingredients contained in the tobacco components. In this case, too, the savor and taste inherent in tobacco material cannot be fully added to the expanded tobacco material. In Patent Document 2, the water-soluble ingredients of the tobacco components are extracted by absorbing the water-soluble ingredients into high-pressure carbon dioxide and then circulating the high-pressure carbon dioxide through the water in an extraction vessel. During the circulation of the high-pressure carbon dioxide, the high-pressure carbon dioxide gets more and more contaminated. Such contamination decreases a high-pressure carbon dioxide's absorption capacity to absorb the water-soluble ingredients, and increases time required to extract the water-soluble ingredients from the tobacco components.

It is an object of the invention to provide a flavor-producing apparatus that retrieves fat-soluble ingredients and water-soluble ingredients, which are contained in tobacco components, separately from tobacco material to produce a flavor suitable for expanded tobacco material out of the fat-soluble and water-soluble ingredients, and reduces time required for flavor production, and a method of producing the same.

In order to achieve the above object, a flavor-producing apparatus of the present invention comprises an extraction vessel for containing tobacco material; a first retrieval path for supplying supercritical carbon dioxide into the extraction vessel to dissolve tobacco components of the tobacco material in the carbon dioxide, and retrieving fat-soluble ingredients from the dissolved tobacco components; a divergent path branching off from the first retrieval path, the divergent path being connected to the first retrieval path in the downstream and upstream of the extraction vessel; an absorption vessel inserted in the divergent path, for storing purified water inside; switching means for selectively forming a closed circulation path, which includes the extraction vessel and the absorption vessel, in the first retrieval path and the divergent path; circulation means for circulating the supercritical carbon dioxide in the circulation path, and absorbing water-soluble ingredients, which are contained in the tobacco components dissolved in the carbon dioxide, into the purified water within the absorption vessel; a second retrieval path for retrieving the purified water, in which the water-soluble ingredients of the tobacco components are absorbed, from the absorption vessel as absorption water; and purification means for purifying carbon dioxide in between the absorption vessel and the tobacco material within the extraction vessel as viewed into a flow direction of the carbon dioxide at least while the carbon dioxide is circulated through the circulation path.

A producing method of the invention which accomplishes the above object includes a first retrieving step of bringing supercritical carbon dioxide into contact with tobacco material within an extraction vessel to dissolve tobacco components of the tobacco material in the carbon dioxide, and retrieving fat-soluble ingredients from the dissolved tobacco components; a circulating step of circulating the carbon dioxide at constant pressure while maintaining the temperature of the extraction vessel higher than the temperature of an absorption vessel in between the extraction vessel and the absorption vessel storing purified water, and making the purified water in the extraction vessel absorb water-soluble ingredients contained in the tobacco components dissolved in the carbon dioxide, the circulating step including a purification process of purifying the carbon dioxide in the process where the carbon dioxide moves from the absorption vessel to the tobacco material in the extraction vessel; and a second retrieving step of retrieving the purified water that has absorbed the water-soluble ingredients from the absorption vessel as absorption water.

According to the above-described producing apparatus and method, the supercritical carbon dioxide is first supplied into the extraction vessel through the first retrieval path. In the extraction vessel, the carbon dioxide contacts the tobacco material, and the tobacco components of the tobacco material are dissolved in the carbon dioxide. At the same time, a portion of the carbon dioxide is impregnated into the tobacco material.

The carbon dioxide dissolved with the tobacco components thereafter flows out of the extraction vessel through the first retrieval path. In this process, the fat-soluble ingredients contained in the tobacco components are retrieved from the carbon dioxide. More specifically, a pressure separation method can be employed for the retrieval in this case.

The switching means forms the closed circulation path out of the first retrieval path and a separation path. In the circulation path, the supercritical carbon dioxide is circulated by the circulation means. The carbon dioxide is circulated in a state where the temperature of the extraction vessel is maintained higher than that of the absorption vessel, and where the carbon dioxide is maintained at constant pressure. When the supercritical carbon dioxide is circulated, the carbon dioxide dissolved with the tobacco components passes through the purified water within the absorption vessel. At this moment, the water-soluble ingredients contained in the tobacco components are absorbed in the purified water within the absorption vessel. The carbon dioxide that has passed through the absorption vessel is purified by the purification means and moves toward the tobacco material within the extraction vessel.

After the absorption of the water-soluble ingredients is finished, the purified water that has absorbed the water-soluble ingredients of the tobacco components is retrieved from the absorption vessel through the second retrieval path as absorption water.

The fat-soluble and water-soluble ingredients of the tobacco components, which have been retrieved from the tobacco material, are used for producing a flavor for expanded tobacco material.

The purification means and process may use activated carbon. To be more specific, the activated carbon forms a layer in the extraction vessel, and this activated carbon layer is located upstream of the tobacco material.

Preferably, the absorption water that has been retrieved from the absorption vessel is radiated by ultraviolet rays or brought into contact with ozone.

More specifically, in order to produce the flavor from the absorption water, the absorption water is concentrated.

The producing apparatus and method of the invention separately extracts the fat-soluble and water-soluble ingredients of the tobacco components from the tobacco material, so that it is possible to efficiently extract the fat-soluble and water-soluble ingredients. The original savor and taste of expanded tobacco material are reproduced when the extracted fat-soluble and water-soluble ingredients are used to produce the flavor for expanded tobacco material, and this flavor is added to the expanded tobacco material.

During the extraction of the water-soluble ingredients, the supercritical carbon dioxide circulates between the extraction vessel and the absorption vessel while being purified. Therefore, the carbon dioxide passing through the tobacco material within the extraction vessel can maintain a dissolution ability of tobacco components. This makes it possible to reduce time for the water-soluble ingredients of the tobacco components to be saturated in the purified water within the absorption vessel, that is, time required for the extraction of the water-soluble ingredients.

BRIEF DESCRIPTION OF THE DRAWING

FIG. is a schematic view of an apparatus for producing a flavor from tobacco material.

BEST MODE OF CARRYING OUT THE INVENTION

A producing apparatus shown in FIG. 1 has an extraction vessel 2. The extraction vessel 2 is an openable and closable pressure vessel and includes a purification layer 4 at a bottom thereof. The purification layer 4 is made of activated carbon. Tobacco material A is contained in the extraction vessel 2 to be located on the purification layer 4.

The activated carbon forming the purification layer 4 makes up 5 to 50 weight percent in relation to the tobacco material A within the extraction vessel 2. The tobacco material A may be tobacco leaves. According to this embodiment, however, the tobacco material A is shred tobacco obtained by shredding tobacco leaves. The tobacco material A has a moisture content ranging from 8 to 30 percent DB.

The extraction vessel 2 has a drain valve 6 at the bottom. When the drain valve 6 is opened, pressure in the extraction vessel 2 is decreased at given speed.

The extraction vessel 2 is inserted in a first retrieval path 8. The first retrieval path 8 includes an upstream section 8*u*. The upstream section 8*u* extends from the bottom of the extraction vessel 2 and is connected to a supply source (not shown) of liquid carbon dioxide (liquid $CO_2$). A supply pump 10 and a heat exchanger 12 are inserted in the upstream section 8*u* in the order from the supply source side. The supply pump 10 delivers liquid carbon dioxide from the supply source toward the heat exchanger 12. A delivery amount of the liquid carbon dioxide from the supply pump 10 ranges from 10 to 100 kg/hr, or preferably from 25 to 50 kg/hr, with respect to 1 kg-WM of tobacco material within the extraction vessel 2.

The first retrieval path 8 further includes a downstream section 8*d* extending from a top of the extraction vessel 2 and being connected to a separation vessel 14. A pressure-regulating valve 16 is inserted in the downstream section 8*d*. The pressure-regulating valve 16 brings the liquid carbon dioxide supplied from the supply pump 10 to the extraction vessel 2 into a supercritical state in cooperation with the heat exchanger 12.

To be more specific, the pressure in the extraction vessel 2 is maintained in a range of from 7.3 to 30 MPa (preferably 10 to 25 MPa), and temperature in the extraction vessel 2 from 32 to 100° C. (preferably 35 to 70° C.). In order to control the temperature and pressure in the extraction vessel 2, the extraction vessel 2 has a thermometer 18. The first retrieval path 8 has a pressure gauge 20 and a flowmeter 22. The pressure gauge 20 is set between the extraction vessel 2 and the pressure-regulating valve 16, and the flowmeter 22 between the extraction vessel 2 and the heat exchanger 12.

The separation vessel 14 is an openable and closable pressure vessel like the extraction vessel 2, and is surrounded by a water jacket (not shown). A return path 24 extends from the separation vessel 14. The return path 24 is connected to the first retrieval path 8 at a position upstream from the supply pump 10. In the return path 24, a pressure-regulating valve 26, a gas refinery tower and a heat exchanger are inserted in the order from the separation vessel 14 side. FIG. 1 does not show the gas refinery tower and the heat exchanger.

The pressure-regulating valve 26 serves to keep pressure in the separation vessel 14 lower than critical pressure of carbon dioxide. The water jacket of the separation vessel 14 serves to keep temperature in the separation vessel 14 equal to or higher than temperature, at which the carbon dioxide within the separation vessel 14 becomes saturated, at pressure that is set by the pressure-regulating valve 26. In order to achieve this end, the separation vessel 14 has a thermometer 28, and the return path 24 has a pressure gauge 30.

The return path 24 draws in $CO_2$ gas from the separation vessel 14. After passing through the pressure-regulating valve 26, the $CO_2$ gas is refined by the gas refinery tower. The refined $CO_2$ gas is liquidized again when passing through the heat exchanger. As a result, the liquidized carbon dioxide is returned to a suction side of the supply pump 10.

A divergent path 32 branches off from the first retrieval path 8. The divergent path 32 has an upstream end and a downstream end connected to the downstream section 8*d* and the upstream section 8*u*, respectively, of the first retrieval path 8. More specifically, the upstream end of the divergent path 32 is located between the extraction vessel 2 and the pressure-regulating valve 16, and the downstream end of the separation path 32 between the supply pump 10 and the heat exchanger 12. A direction switching valve 34 is inserted between the upstream section 8*u* and the downstream end of the divergent path 32. The direction switching valve 34 has a first switch position that connects the supply pump 10 to the heat exchanger 12, and blocks the connection between the heat exchanger 12 and the divergent path 32, and a second switch position that blocks the connection between the supply pump 10 and the heat exchanger 12, and connects the heat exchanger 12 to the divergent path 32.

A direction switching valve 36 is inserted between the downstream section 8*d* and the upstream end of the divergent path 32. The direction switching valve 36 has a first switch position that connects the extraction vessel 2 to the pressure-regulating valve 16, and blocks the connection between the extraction vessel 2 and the divergent path 32, and a second switch position that blocks the connection between the extraction vessel 2 and the pressure-regulating valve 16, and connects the extraction vessel 2 to the divergent path 32.

When the direction switching valves 34 and 36 are in the first switch positions, the divergent path 32 is separated from the first retrieval path 8. On the other hand, when the direction switching valves 34 and 36 are switched from the first to the second switch position, the divergent path 32 forms a closed circulation path in cooperation with a section of the first retrieval path 8. The extraction vessel 2 and the heat exchanger 12 are included in the circulation path.

An absorption vessel 38 is inserted in the divergent path 32. The absorption vessel 38, too, is a pressure vessel. A bottom of the absorption vessel 38 and the direction switching valve 36 are connected to each other through an upstream section 32*u* of the divergent path 32. A top of the absorption vessel 38 and the direction switching valve 34 are connected to each other through a downstream section 32*d* of the divergent path 32.

The absorption vessel 38 stores purified water inside. This purified water is either distilled water or ion-exchange water. The purified water stored in the absorption vessel 38 has a capacity that is 0.2 to 6 times as much as the amount of the tobacco material A within the extraction vessel 2.

A circulation pump 40 and a heat exchanger 42 are inserted in the downstream section 32*d* and the upstream section 32*u*, respectively, of the divergent path 32. When the direction switching valves 34 and 36 are switched to the second switch positions, and the closed circulation path is formed as described above, the circulation pump 40 is activated. The activation of the circulation pump 40 circulates the supercritical carbon dioxide existing in the circulation path through the extraction vessel 2 and the absorption vessel 38 at constant pressure. At the same time, the heat exchanger 42 regulates the temperature of the carbon dioxide flowing toward the absorption vessel 38 and keeps the temperature in the absorption vessel 38 lower than that in the extraction vessel 2. As a result, relative solubility of the purified water with respect to the carbon dioxide falls within a range of from 60 to 70 percent. In order to achieve the end, the absorption vessel 38 has a thermometer 44.

The circulation pump 40 has ability for delivering carbon dioxide, which ranges from 80 to 500 kg/hr (preferably 150 to 400 kg/hr) with respect to 1 kg-WM of the tobacco material and is 3 to 10 times as high as the ability of the supply pump 10.

A second retrieval path 46 extends from the bottom of the absorption vessel 38. The second retrieval path 46 is connected to a thickener 48. As the thickener 48, any one of a vacuum freeze dryer, a centrifugal thin-film vacuum evaporator and a vacuum evaporator may be used. It is desirable that the thickener 48 should operate at low temperature and low pressure.

An open/close valve 50, a retrieval vessel 52, an open/close valve 54 and a delivery pump 56 are inserted in the second retrieval path 46 in the order from the absorption vessel 38 side. The retrieval vessel 52 is connected with an ultraviolet irradiator 58 through a circulation conduit 60. The circulation conduit 60 has a circulation pump 62. The ultraviolet irradiator 58 includes a built-in ultraviolet-ray lamp (not shown). Ultraviolet rays emitted by the ultraviolet-ray lamp have a wavelength range with a central wavelength of 365 nm. The retrieval vessel 52 is further connected with an ozone generator 64. The ozone generator 64 is capable of continuously supplying ozone to the retrieval vessel 52.

The following description is about a method of producing a flavor from the tobacco material A by using the foregoing apparatus.

First, the purification layer 4 is formed at the bottom in the extraction vessel 2. The tobacco material A is filled in the extraction vessel 2 to be accumulated on the purification layer 4. At this time, the direction switching valves 34 and 36 have been switched to the first switch positions.

In such a state, the supply pump 10 is activated to supply liquid carbon dioxide to the upstream section 8*u* of the first retrieval path 8. The liquid carbon dioxide is accordingly supplied through the heat exchanger 12 into the extraction vessel 2. At this circumstance, the heat exchanger 12 raises the temperature of the liquid carbon dioxide up to an extraction temperature equal to or higher than critical temperature of the liquid carbon dioxide.

The liquid carbon dioxide is discharged from the extraction vessel 2 to the downstream section 8*d* of the first retrieval path 8 and reaches the pressure-regulating valve 16. The pressure-regulating valve 16 keeps pressure in the first retrieval path 8, which is located upstream from the pressure-regulating valve 16, at an extraction pressure equal to or higher than critical pressure of a carbon dioxide. Therefore, the carbon dioxide supplied into the extraction vessel 2 comes into a supercritical state.

In the extraction vessel 2, the supercritical carbon dioxide contacts the tobacco material A after passing through the purification layer 4. As a result, tobacco components of the tobacco material A are dissolved in the carbon dioxide. When pressure in a section of the first retrieval path 8, which is located upstream from the pressure-regulating valve 16, is increased to be equal to or higher than the extraction pressure, the pressure-regulating valve 16 is temporarily opened. Accordingly, extra carbon dioxide in which the tobacco components are dissolved is supplied from the extraction vessel 2 into the separation vessel 14 through the pressure-regulating valve 16. By the pressure-regulating valve 26 of the return path 24, the pressure in the separation vessel 14 is maintained lower than the critical pressure of carbon dioxide. The temperature of the separation vessel 14 is also maintained lower than the critical temperature of carbon dioxide. When the supercritical carbon dioxide is supplied into the separation vessel 14, the tobacco components dissolved in the carbon dioxide is separated from the carbon dioxide in the separation vessel 14, and is retrieved on the bottom of the separation vessel 14. The carbon dioxide, from which the tobacco components have been separated, is returned from the separation vessel 14 to the upstream side of the supply pump 10 through the return path 24. A first extraction process as mentioned above is continued at least for three minutes or more. Time required for the first extraction process makes up 10 to 50 percent of the total extraction time. The total extraction time will become clear from the following explanation.

After the first extraction process is finished, the direction switching valves 34 and 36 are switched from the first to the second switch positions, and simultaneously, the operation of the supply pump 10 is stopped. The separation vessel 14 is separated from the extraction vessel 2 located on a high-pressure side. In this state, the tobacco components in the separation vessel 14 are dissolved or suspended in ethanol, and retrieved from the separation vessel 14 as a first flavor element. The first flavor element contains fat-soluble ingredients of the tobacco components.

After the first extraction process is finished, a second extraction process is carried out in parallel with the retrieval of the first flavor element. In the second extraction process, the circulation pump 40 is activated. At this time, the direction switching valves 34 and 36 have been switched to the second positions. Therefore, the path including the extraction vessel 2 and the circulation pump 40 forms the circulation path, which includes the absorption vessel 38. The carbon dioxide within the circulation path is maintained at constant pressure. The activation of the circulation pump 40 circulates the supercritical carbon dioxide between the extraction vessel 2 and the absorption vessel 38. Consequently, water-soluble ingredients of the tobacco components dissolved in the carbon dioxide are absorbed by the purified water in the absorption vessel 38. The temperature in the absorption vessel 38 is kept lower than that in the extraction vessel 2, and the relative solubility of the purified water with respect to carbon dioxide ranges from 60 to 70 percent. Therefore, the moisture of the tobacco material A can be kept in a range of from 14 to 20 percent DB.

The second extraction process is carried out within a duration of 10 minutes to four hours at the most, which is 50 to 10 percent of the total extraction time.

During the second extraction process, after passing through the absorption vessel 38, the supercritical carbon dioxide returns to the extraction vessel 2 through the circulation pump 40 and passes through the purification layer 4 in the extraction vessel 2. Since the purification layer 4 is made of activated carbon, the supercritical carbon dioxide is purified every time passing through the purification layer 4. In the extraction vessel 2, the tobacco components of the tobacco material A are well dissolved in the supercritical carbon dioxide. Concentration of the water-soluble ingredients of the tobacco components extracted into the purified water within the absorption vessel 38 quickly comes to equilibrium. This drastically reduces time required for the second extraction process.

When the second extraction process is finished, the operation of the circulation pump 40 is stopped. The open/close valve 50 of the second retrieval path 46 is then opened. The purified water in the absorption vessel 38, that is, absorption water that has absorbed the water-soluble ingredients of the tobacco components, is transferred from the absorption vessel 38 to the retrieval vessel 52 through the second retrieval path 46.

The circulation pump 62 is subsequently activated. The absorption water within the retrieval vessel 52 circulates between the retrieval vessel 52 and the ultraviolet irradiator 58. The ultraviolet irradiator 58 applies the ultraviolet rays to the absorption water. The ozone generator 64 is capable of supplying ozone to the retrieval vessel 52 prior to or after or simultaneously with the irradiation of the ultraviolet rays. The ozone is then brought into contact with the absorption water.

When the above-mentioned ultraviolet and ozone treatments are finished, the operation of the circulation pump 62 is stopped. The absorption water within the ultraviolet irradiator 58 and the circulation conduit 60 is all retrieved into the retrieval vessel 52. The open/close valve 54 of the second retrieval path 46 is opened. At the same time, the delivery pump 56 is activated, and the absorption water within the retrieval vessel 52 is supplied to the thickener 48. The thickener 48 increases the concentration of the water-soluble ingredients within the absorption water, to thereby produce a second flavor element.

The first and second flavor elements are sprayed, or added, to expanded tobacco material mentioned below. The first and second flavor elements may be separately added to the expanded tobacco material. Alternatively, a flavor made of a mixture of the first and second flavor elements may be produced and added by spray to the expanded tobacco material.

Production of the expanded tobacco material will be described below.

Since the extraction vessel 2 has the pressure and temperature sufficient to impregnate carbon dioxide into the tobacco material A, the carbon dioxide required for expansion of the tobacco material A is well impregnated into the tobacco material A within the extraction vessel 2 after the first and second extraction processes are finished. The tobacco material A within the extraction vessel 2 is removed from the extraction vessel 2 and immediately supplied to a flash dryer 66. The flash dryer 66 rapidly heats and dries the tobacco material A into which the carbon dioxide is impregnated. This drying treatment rapidly vaporizes the carbon dioxide within the tobacco material A. The vaporized carbon dioxide is immediately removed from the tobacco material A and then expands the tobacco material A.

The expanded tobacco material A thus obtained is supplied to an addition processor 68. The first and second flavor elements or the flavor is added to the expanded tobacco material A by the addition processor 68.

The savor and taste of the expanded tobacco material A, which are inherent in the tobacco material, can be recovered by adding both the first and second flavor elements to the expanded tobacco material A. For this reason, when the expanded tobacco material A is used to produce cigarettes, a smoker can enjoy the savor and taste of the tobacco material itself during smoking of the produced cigarettes. In this way, the cigarettes are vastly improved in quality.

If the pressure in the extraction vessel 2 is drastically reduced when the tobacco material A is removed from the extraction vessel 2, this incurs liquidation and/or solidification of the carbon dioxide. Therefore, the tobacco material A is occasionally solidified with dry ice. In order to prevent such solidification of the tobacco material A, the liquidized carbon dioxide is gradually discharged through the drain valve 6. The pressure reduction in the extraction vessel 2 is slowly carried out.

The activated carbon of the purification layer 4, which has been used for extraction, becomes reusable by being reproduced after being heated at a temperature of 180° C. or more in an anoxic atmosphere or by being subjected to a reactivation treatment.

A specific embodiment will be described below.

[Embodiment]

First, 360 grams of granular activated carbon was filled in the extraction vessel 2, and the purification layer 4 was formed at the bottom of the extraction vessel 2. Subsequently, 1200 grams of shred tobacco was filled in the extraction vessel 2. The shred tobacco filled in the extraction vessel 2 was Burley type made in the U.S.A. and had a moisture content of 19 percent DB. 1300 grams of purified water was contained in the absorption vessel 38.

In this state, the supply pump 10 was activated. Supercritical carbon dioxide was supplied into the extraction vessel 2 by a supply rate of 50 kg/hr, and the first extraction process was carried out for five minutes. Pressure and temperature in the extraction vessel 2 were 25 MPa and 50° C., respectively. Pressure and temperature in the separation vessel 14 were 5 MPa and 30° C., respectively.

After the first extraction process was finished, the circulation pump 40 was activated, and the second extraction process took place. In the second extraction process, the supercritical carbon dioxide circulated through the circulation path at a flow rate of 440 kg/hr for a duration of two hours.

Thereafter, the tobacco shred removed from the extraction vessel 2 included 4 percent DB of carbon dioxide. The impregnated tobacco shred was heated and dried by flash drying to be expanded. Conditions for the flash drying here, that is, heating temperature, flow velocity, and vapor percentage of a dry air flow, were 355° c., 8.5 m/s, and 82 vol percent, respectively. The expanded tobacco shred thus obtained had a moisture content of 2.5 percent DB.

Thereafter, the expanded tobacco shred was subjected to a moisture-adjusting treatment. The moisture-adjusting treatment was carried out by preserving the expanded tobacco in a room where temperature and relative moisture were kept at 22° c. and 60 percent, respectively, for a duration of three days.

The expanded shred tobacco that had been adjusted in moisture was measured in expansivity by using a densimeter (DD-60A type manufactured by Borgwaldt, Germany). The measurement result was 11.72 cc/g. Shred tobacco that had not been subjected to the expansion treatment was also measured by the same densimeter. The result was 5.22 cc/g. These results show that the expanded shred tobacco has expansion volume that is more than twice the volume of the unexpanded shred tobacco, and that the expanded shred tobacco exerts a high filling rate with respect to cigarettes.

All the absorption water within the absorption vessel 38 was removed, and a portion (180 g) of the absorption water was irradiated with ultraviolet rays for a duration of three hours by using a plate-type ultraviolet treatment device. The ultraviolet irradiator utilized here included a tank for storing the absorption water. The tank had two silica glass plates forming side walls thereof. Each glass plate had a thickness, width, and length of 5 mm, 200 mm, and 300 mm, respectively. When 180 grams of the absorption water was put into the tank, a water level of the absorption water within the tank is approximately 65 mm.

The ultraviolet irradiator included two ultraviolet light sources (FL287-BL-NHF-GLC, 8W tube, manufactured by DENTSU-SANGYO K.K.) which were horizontally arranged across the tank. These light sources were capable of irradiating the absorption water within the tank with ultraviolet rays having a wavelength range from 350 to 400 nm (central wavelength 365 nm) through the glass plates.

After the treatment of the absorption water using the ultraviolet treatment device, the intensity of the ultraviolet rays passing through the absorption water within the tank was measured with an ultraviolet intensity meter (UVX-365 manufactured by UVP, Inc., U.S.A.). The measurement result was 0.38 mW/cm$^2$. The intensity of the ultraviolet rays was measured in the same fashion on the condition that the tank was empty, and the result was 1.1 mW/cm$^2$.

Thereafter, 120 grams of the absorption water that had been irradiated with the ultraviolet rays was condensed with a vacuum freeze dryer serving as a thickener. Water was added to this condensed material, and 1.3 grams of the second flavor element was produced.

10 grams of ethanol was added to fat-soluble ingredients of tobacco components within the separation vessel 14, and the first flavor element was produced. All the first flavor element was removed from the separation vessel 14.

1.3 grams of the second flavor element was added by spray to 120.2 grams of the expanded shred tobacco. 2.2 grams of the first flavor element was subsequently added by spray to the same expanded shred tobacco. A ratio of the addition amount of the first and second flavor elements to the expanded shred tobacco was determined on the basis of weight of tobacco material to be subjected to the extraction treatment, an extraction amount of the fat-soluble ingredients of the tobacco components retrieved into the separation vessel 14, and an amount of the water-soluble ingredients of the tobacco components retrieved into the purified water within the absorption vessel 38. The amount of the water-soluble ingredients can be obtained from difference between the weight of the absorption water within the absorption vessel 38 and the weight of the purified water supplied into the absorption vessel 38 after the first extraction process.

Thereafter, the expanded shred tobacco to which the first and second flavor elements had been added was preserved for two days in a room where temperature and relative moisture were kept at 22° c. and 60 percent, respectively. In this manner, the expanded shred tobacco was adjusted in moisture content. The expanded shred tobacco of the present invention was then used to produce cigarettes in a cigarette manufacturing apparatus.

Meantime, cigarettes for comparison were produced according to a method disclosed in Examined Japanese Patent Publication No. Sho 56-50830. In the impregnation vessel for this method, shred tobacco of Burley type made in the U.S.A. (25.2 percent DB in moisture content) was immersed in liquid carbon dioxide having a pressure of 5 MPa for one minute. Thereafter, the liquid carbon dioxide was discharged from the impregnation vessel in the state where the pressure in the impregnation vessel was kept at 5 MPa. The impregnated shred tobacco was kept in the impregnation vessel for two minutes with the pressure within the impregnation vessel kept at the same value. As a result, the extra liquid carbon dioxide was discharged from the impregnated shred tobacco due to gravity. The pressure in the impregnation vessel was reduced to ambient pressure, and the impregnated shred tobacco was removed from the impregnation vessel.

The impregnated shred tobacco was subjected to an expansion treatment under the same flash drying conditions as in the above-described embodiment, to thereby produce expanded shred tobacco. This expanded shred tobacco had a moisture content of 2.4 percent DB. The expanded shred tobacco was subjected to the moisture-adjusting treatment on the same conditions as in the embodiment, and then measured in expansivity by using the same densimeter. The measurement result was 11.66 cc/g, and approximated 1.72 cc/g indicative of the expansiveness in the embodiment.

The expanded shred tobacco was then formed into cigarettes for comparison by using the cigarette manufacturing apparatus. Meantime, cigarettes as reference were produced. The cigarettes as reference were the same as the cigarettes of the embodiment, except that the expanded shred tobacco of the cigarettes as reference does not include the first and second flavor elements.

Table 1 below shows results of an evaluation test on the quality of the cigarettes of the embodiment and reference on the basis of the cigarettes for comparison.

TABLE 1

| Sorting | Ease of smoking | Fullness of smoke | Reduction degree of bad characteristics (pungency) |
|---|---|---|---|
| Embodiment | +3.0 | +2.2 | +2.8 |
| Reference | +1.6 | −2.6 | +1.4 |

The evaluation test was carried out by five professional sensory judges. The judges graded the qualities of the cigarettes of the embodiment and reference, including the ease of smoking, the fullness of the smoke and a reduction degree of bad characteristics, on a scale of −3 to +3 using the cigarettes for comparison as standard. Table 1 shows average values of results of the evaluation carried out by the five judges.

On a scale of −3 to +3, the judges compared the cigarettes of the embodiment and reference to those for comparison. The judges scored the cigarettes of the embodiment and reference at 0 when determining that there was no difference between the cigarettes of the embodiment and reference and those for comparison, at 1 when there was slight difference, at 2 when there was a recognizable difference, and at 3 when there was a great difference. When the cigarettes of the embodiment and reference were improved as compared to those for comparison, the scores were positive values. On the contrary, when the cigarettes of the embodiment and reference were inferior to those for comparison, the scores were negative values. As is apparent from Table 1, the cigarettes of the embodiment are remarkably improved as compared to those of the reference in all evaluation items including "Ease of smoking," "Fullness of the smoke (richness of mainstream smoke)" and "Reduction degree of bad characteristics."

Table 2 below shows evaluation results concerning suitability of the expanded shred tobacco used for the cigarettes of the embodiment. The suitability of the expanded shred tobacco indicates a limit to which a blend ratio of the expanded shred tobacco can be increased while preventing the expanded shred tobacco from adversely affecting the savor and taste of the produced cigarettes when the expanded shred tobacco is used to produce the cigarettes by being mixed with other shred tobacco materials.

TABLE 2

| Blend ratio (%) | | | | |
|---|---|---|---|---|
| Base shreds | Expanded shred tobacco | Midrib shreds | Sheet shreds | Judgment |
| 65 | 20 | 10 | 5 | 4 |
| 55 | 30 | 10 | 5 | 4 |

TABLE 2-continued

| Blend ratio (%) | | | | |
|---|---|---|---|---|
| Base shreds | Expanded shred tobacco | Midrib shreds | Sheet shreds | Judgment |
| 45 | 40 | 10 | 5 | 4 |
| 35 | 50 | 10 | 5 | 3 |
| 25 | 60 | 10 | 5 | 2 |
| 15 | 70 | 10 | 5 | 2 |

In Table 2, base shreds mean shred tobacco material obtained by shredding tobacco leaves from which midribs are removed. Midrib shreds mean shred tobacco material obtained by shredding the midribs, and sheet shreds mean shred tobacco material obtained by shredding reconstructed sheet tobacco.

Judgment in Table 2 shows the results of the evaluation conducted by the five professional sensory judges through discussion on a scale of 1 to 4. Scores 1 to 4 denote as follows:

4: The cigarettes have excellent savor and taste.

3: The cigarettes have good savor and taste.

2: The cigarettes have satisfactory savor and taste.

1: The cigarettes have poor savor and taste.

As is clear from Table 2, even if the blend ratio of the expanded tobacco shreds is increased up to 50 percent, the savor and taste of the cigarettes are good, and the expanded shred tobacco exerts an excellent suitability.

As is shown in Table 2, the blend ratio of the midrib shreds and that of the sheet shreds are fixed. If the blend ratio of the midrib shreds and that of the sheet shreds are reduced, the blend ratio of the expanded shred tobacco can be increased.

Meantime, cigarettes were produced by using expanded shred tobacco that was obtained by a method according to Embodiment 2 described in Patent Document 1. These cigarettes were evaluated as cigarettes for comparison in the same manner as with those of the embodiment shown in Table 1. Evaluation results are shown in Table 3 below.

TABLE 3

| Sorting | Ease of smoking | Fullness of smoke | Reduction degree of bad characteristics |
|---|---|---|---|
| Embodiment | +2.0 | +1.6 | +2.0 |

As is evident from Table 3, as compared to the expanded shred tobacco obtained in Embodiment 2 of Patent Document 1, the expanded shred tobacco of the embodiment are not only excellent in savor and taste but also improved in the other qualities, such as the ease of smoking and the fullness of the smoke.

The invention is not restricted by the foregoing embodiments and may be modified in various ways.

For example, it is possible to insert a purification vessel 70 in the divergent path 32 in replacement of the purification layer 4 as shown by a chain double-dashed line in FIG. 1. The purification vessel 70 is placed downstream of the absorption vessel 38. Granular activated carbon is filled in the purification vessel 70. The direction switching valves 34 and 36 may be replaced with a pair of open/close valves, respectively.

The invention claimed is:

1. An apparatus for producing a flavor to be added to expanded tobacco material, comprising:

an extraction vessel for storing tobacco material;

a first path extending through said extraction vessel, for supplying supercritical carbon dioxide into said extraction vessel to dissolve tobacco components of the tobacco material in the carbon dioxide;

a separation vessel inserted in said first path downstream of said extraction vessel and storing a solvent inside, for absorbing fat-soluble ingredients from the dissolved tobacco components into the solvent;

a divergent path branching off from said first path at a location between said extraction vessel and said separation vessel, said divergent path being connected to the first path in the upstream of said extraction vessel;

an absorption vessel inserted in the divergent path, for storing purified water inside;

a switching device for selectively forming a closed circulation path, which includes said extraction vessel and said absorption vessel, out of the first path and the divergent path;

a circulation pump for circulating the supercritical carbon dioxide in the circulation path and absorbing water-soluble ingredients, which are contained in the tobacco components dissolved in the carbon dioxide, into the purified water within said absorption vessel;

a second path for retrieving the purified water, in which the water-soluble ingredients of the tobacco components are absorbed, from said absorption vessel as absorption water; and a purification device for purifying the carbon dioxide in between said absorption vessel and the tobacco material within said extraction vessel as viewed in a flow direction of the carbon dioxide at least while the carbon dioxide is circulated through the circulation path.

2. The apparatus according to claim 1, wherein said purification device includes activated carbon stored in the upstream of the tobacco material within said extraction vessel.

3. The apparatus according to claim 1, wherein said second path includes an ultraviolet irradiation device for irradiating ultraviolet rays onto the absorption water.

4. The apparatus according to claim 1, wherein said second path includes an ozone supply device for bringing the absorption water into contact with ozone.

5. The apparatus according to claim 1, wherein said second path includes a thickening device for thickening the water-soluble ingredients within the absorption water.

* * * * *